US011629476B2

(12) United States Patent
Zhao et al.

(10) Patent No.: US 11,629,476 B2
(45) Date of Patent: Apr. 18, 2023

(54) GRADER AND BLADE CONTROL METHOD

(71) Applicant: JIANGSU XCMG CONSTRUCTION MACHINERY RESEARCH INSTITUTE LTD., Jiangsu (CN)

(72) Inventors: Bin Zhao, Xuzhou (CN); Hao Liu, Xuzhou (CN); Zhiqiang Hou, Xuzhou (CN); Letian Zhang, Xuzhou (CN)

(73) Assignee: JIANGSU XCMG CONSTRUCTION MACHINERY RESEARCH INSTITUTE LTD., Jaingsu (CN)

( * ) Notice: Subject to any disclaimer, the term of this patent is extended or adjusted under 35 U.S.C. 154(b) by 274 days.

(21) Appl. No.: 17/095,929

(22) Filed: Nov. 12, 2020

(65) Prior Publication Data

US 2022/0049454 A1 Feb. 17, 2022

(30) Foreign Application Priority Data

Aug. 12, 2020 (CN) ..... 202010808493.7

(51) Int. Cl.

| | |
|---|---|
| ***E02F 3/76*** | (2006.01) |
| ***E02F 3/84*** | (2006.01) |
| ***E02F 9/22*** | (2006.01) |

(52) U.S. Cl.

CPC ..... *E02F 3/765* (2013.01); *E02F 3/845* (2013.01); *E02F 9/2278* (2013.01)

(58) Field of Classification Search

CPC ..... E02F 3/764; E02F 3/7645; E02F 3/7636; E02F 3/844; E02F 3/845; E02F 3/765

See application file for complete search history.

(56) References Cited

U.S. PATENT DOCUMENTS

| | | | | |
|---|---|---|---|---|
| 5,365,442 | A * | 11/1994 | Schmidt | A01B 63/114 701/50 |
| 8,103,417 | B2 * | 1/2012 | Gharsalli | E02F 3/844 318/587 |
| 10,316,491 | B2 * | 6/2019 | Gentle | E02F 9/262 |
| 10,557,250 | B1 | 2/2020 | Ennis et al. | |

(Continued)

FOREIGN PATENT DOCUMENTS

| | | | |
|---|---|---|---|
| CN | 101377684 | A | 3/2009 |
| CN | 104131587 | A | 11/2014 |

(Continued)

*Primary Examiner* — Jamie L McGowan

(74) *Attorney, Agent, or Firm* — Myers Bigel, P.A.

(57) ABSTRACT

A grader and a blade control method wherein the grader includes: a blade mechanism including a blade; a blade adjusting mechanism including a plurality of adjusting means respectively corresponding to at least two degrees of freedom of the blade, and configured to adjust a spatial position and/or angle of the blade; a blade position detecting mechanism configured to detect a slope parameter for characterizing a spatial position of the blade; a motion trajectory library configured to store motion functions of the plurality of adjusting means respectively when different operation conditions and/or different grades are switched; a controller configured to call a corresponding motion function in the motion trajectory library according to a set operation condition and a required slope, and control at least one of the plurality of adjusting means according to a position parameter of the blade and the motion function.

5 Claims, 5 Drawing Sheets

(56) References Cited

U.S. PATENT DOCUMENTS

| | | | | |
|---|---|---|---|---|
| 10,865,542 | B2 * | 12/2020 | Smith | E02F 3/432 |
| 2002/0162668 | A1 * | 11/2002 | Carlson | E02F 9/26 172/1 |
| 2009/0056961 | A1 | 3/2009 | Gharsalli et al. | |
| 2009/0183886 | A1 * | 7/2009 | Armas | E02F 3/7618 172/779 |
| 2014/0326471 | A1 | 11/2014 | Zhu et al. | |
| 2017/0145655 | A1 * | 5/2017 | Mason | E02F 3/815 |
| 2020/0087888 | A1 | 3/2020 | Kean et al. | |
| 2022/0136203 | A1 * | 5/2022 | Kushner | E02F 3/422 37/403 |

FOREIGN PATENT DOCUMENTS

| | | | |
|---|---|---|---|
| CN | 108487351 | A | 9/2018 |
| CN | 110894730 | A | 3/2020 |
| CN | 111501872 | A | 8/2020 |

* cited by examiner

GRADER AND BLADE CONTROL METHOD

CROSS-REFERENCE TO RELATED APPLICATIONS

The present application is based on and claims priority to CN Patent Application No. 202010808493.7 filed on Aug. 12, 2020, the disclosure of which is incorporated by reference herein in its entirety.

TECHNICAL FIELD

The present disclosure relates to the field of grading operations, in particular to a grader and a blade control method.

BACKGROUND

The grader is a high-speed, high-efficiency, high-precision and multi-purpose earthwork and mining machine. As a core member of the complete machine operation device, the blade is directly in contact with an operation surface during operation of the grader, so that its operating adaptability in multiple operation conditions directly affects the operation efficiency of the complete machine. When the blade is in operation, it is often necessary to adjust a slope of the blade to meet the needs of earthwork such as scraping slope and scraping groove.

SUMMARY

In one aspect of the present disclosure, a grader is provided. The grader includes: a blade mechanism including a blade; a blade adjusting mechanism including a plurality of adjusting means respectively corresponding to at least two degrees of freedom of the blade, operably connected to the blade mechanism, and configured to adjust a spatial position and/or angle of the blade; a blade position detecting mechanism configured to detect a slope parameter for characterizing a spatial position of the blade; a motion trajectory library configured to store motion functions of the plurality of adjusting means respectively when different operation conditions and/or different grades are switched; and a controller communicatively connected with the blade adjusting mechanism, the blade position detecting mechanism and the motion trajectory library, and configured to call a corresponding motion function in the motion trajectory library according to a set operation condition and a required slope, and control at least one of the plurality of adjusting means according to a position parameter of the blade and the motion function.

In some embodiments, the controller has a built-in memory, in which the motion trajectory library is located.

In some embodiments, the blade mechanism further includes: a body frame; a swing frame having a first end rotatably connected with the body frame; and a rotary support rotatably connected with a second end of the swing frame, and wherein the blade is rotatably and slidably arranged on the rotary support.

In some embodiments, the plurality of adjusting means include: a left lift cylinder and a right lift cylinder vertically arranged on left and right sides of the body frame respectively, both connected between the body frame and the second end of the swing frame drive the swing frame to pitch relative to the body frame; a tilt cylinder, connected between the second end of the swing frame and the body frame drive the swing frame to side-swing; a rotary motor, connected between the second end of the swing frame and the rotary support drive the rotary support to rotate relative to the second end of the swing frame; an offset cylinder, connected between the blade and the rotary support drive the blade to slide relative to the rotary support; and an angle cylinder connected between the rotary support and the blade drive the blade to rotate relative to the rotary support.

In some embodiments, the blade adjusting mechanism further includes: a plurality of electro-hydraulic proportional valves connected with the left lift cylinder, the right lift cylinder, the tilt cylinder, the rotary motor, the offset cylinder and the angle cylinder respectively, and all communicatively connected with the controller.

In some embodiments, the grader further includes: a converter, communicatively connected with the controller or integrated in the controller convert a slope parameter detected by the blade position detecting mechanism into a recognizable signal for the controller, and convert a control instruction outputted by the controller into electro-hydraulic proportional signals of the plurality of electro-hydraulic proportional valves.

In some embodiments, the blade position detecting mechanism includes: a first displacement sensor and a second displacement sensor, connected with the left lift cylinder and the right lift cylinder respectively detect displacements of the left lift cylinder and the right lift cylinder respectively; a third displacement sensor, connected to the tilt cylinder detect a displacement of the tilt cylinder; a fourth displacement sensor, connected to the offset cylinder detect a displacement of the offset cylinder; a fifth displacement sensor, connected to the angle cylinder detect a displacement of the angle cylinder; and an angle sensor, connected to the rotary motor detect a rotation angle of the rotary motor.

According to one aspect of the present disclosure, a blade control method of the foregoing grader is provided. The method includes: detecting a slope parameter for characterizing a spatial position of a blade by a blade position detecting mechanism; calling a corresponding motion function in a motion trajectory library according to a set operation condition and a required slope; and controlling at least one of a plurality of adjusting means in a blade adjusting mechanism according to the slope parameter of the blade and the motion function.

In some embodiments, the blade control method further includes: if a current operation condition of the grader is different from the set operation condition, adjusting the blade to an initial position by the blade adjusting mechanism, and then controlling at least one of the plurality of adjusting means according to the motion function, so as to adjust the blade to a spatial position that meets the set operation condition and the required slope; and if a current operation condition of the grader is the same as the set operation condition, controlling at least one of the plurality of adjusting means corresponding to the required slope according to the motion function, and maintaining current states of the other adjusting means among the plurality of adjusting means, so as to directly adjust the blade to a spatial position that meets the set operation condition and the required slope.

In some embodiments, the operation condition includes at least one of the following: a flat shoveling operation condition, a scraping groove operation condition, or a scraping slope operation condition.

In some embodiments, the blade position detecting mechanism includes a plurality of sensors respectively corresponding to the plurality of adjusting means, and the step of detecting a slope parameter for characterizing a spatial position of a blade by a blade position detecting mechanism includes: detecting motion adjustment amounts of the plurality of adjusting means relative to an initial position of the blade by the plurality of sensors respectively; calculating a first angle and a second angle of the blade when the blade is in the flat shoveling operation condition, calculating a first angle and a penetration depth of the blade when the blade is in the scraping groove operation condition, and calculating a third angle of the blade when the blade is in the scraping slope operation condition, according to the motion adjustment amounts of the plurality of adjusting means relative to the initial position of the blade, wherein the first angle is an included angle between a lower edge of the blade and an operation surface of the grader, and the second angle is an included angle between a scraping surface of the blade adjacent to the lower edge and the operation surface, the penetration depth is a distance between the lowest position of the blade and the operation surface, and the third angle is an included angle between a side slope formed after scraping slope by the blade and a horizontal plane.

In some embodiments, the required slope includes at least one of the following: a first angle and a second angle of the blade under the flat shoveling operation condition; a first angle and a penetration depth under the scraping groove operation condition; or a third angle under the scraping slope operation condition.

In one aspect of the present disclosure, a blade control method of the foregoing grader is provided. The method includes: detecting a slope parameter for characterizing a spatial position of a blade by a blade position detecting mechanism; calling a corresponding motion function in a motion trajectory library according to a set operation condition and a required slope; and controlling at least one of a plurality of adjusting means in a blade adjusting mechanism according to the slope parameter of the blade and the motion function.

In some embodiments, the step of detecting a slope parameter for characterizing a spatial position of the blade by the blade position detecting mechanism includes: detecting a displacement X1 of a left lift cylinder and a displacement X2 of a right lift cylinder by a first displacement sensor and a second displacement sensor respectively; detecting a displacement X3 of a tilt cylinder by a third displacement sensor; detecting a displacement X4 of an offset cylinder by a fourth displacement sensor; detecting a rotation angle X5 of a rotary motor by an angle sensor; detecting a displacement X6 of an angle cylinder by a fifth displacement sensor; and calculating a slope parameter of the blade according to the rotation angle and each displacement by referring to a current operation condition of the grader.

In some embodiments, the step of calculating a slope parameter of the blade according to the rotation angle and each displacement by referring to a current operation condition of the grader includes: if the current operation condition of the blade is a flat shoveling operation condition, calculating a first angle $\alpha$ of the blade by a preset first motion function, and calculating a second angle $\beta$ of the blade by a preset second motion function, wherein the preset first motion function is: $\alpha=K1*X1+K2*X2$, the preset second motion function is: $\beta=K6*X6$; if the current operation condition of the blade is a scraping groove operation condition, calculating a first angle $\alpha$ of the blade by the preset first motion function, and calculating a penetration depth H of the blade by a preset third motion function, wherein the preset third motion function is: $H=K1*X1+K2*X2+K4*X4$; and if the current operation condition of the blade is a scraping slope operation condition, calculating a third angle $\theta$ of the blade by a preset fourth motion function, wherein the preset fourth motion function is: $0=K1*X1+K2*X2+K3*X3+K4*X4+K5*X5+K6*X6$, wherein K1, K2, K3, K4, K5, and K6 are all motion coefficients after calibrating a plurality of adjusting means, the first angle $\alpha$ is an included angle between a lower edge of the blade and an operation surface of the grader, the second angle $\beta$ is an included angle between the scraping surface of the blade adjacent to the lower edge and the operation surface, the penetration depth H is a distance between the lowest position of the blade and the operation surface, and the third angle $\theta$ is an included angle between a side slope formed after scraping slope by the blade and a horizontal plane.

BRIEF DESCRIPTION OF THE DRAWINGS

The accompanying drawings, which constitute part of this specification, illustrate exemplary embodiments of the present disclosure, and together with this specification, serve to explain the principles of the present disclosure.

The present disclosure may be more clearly understood from the following detailed description with reference to the accompanying drawings, wherein.

Figure 1:
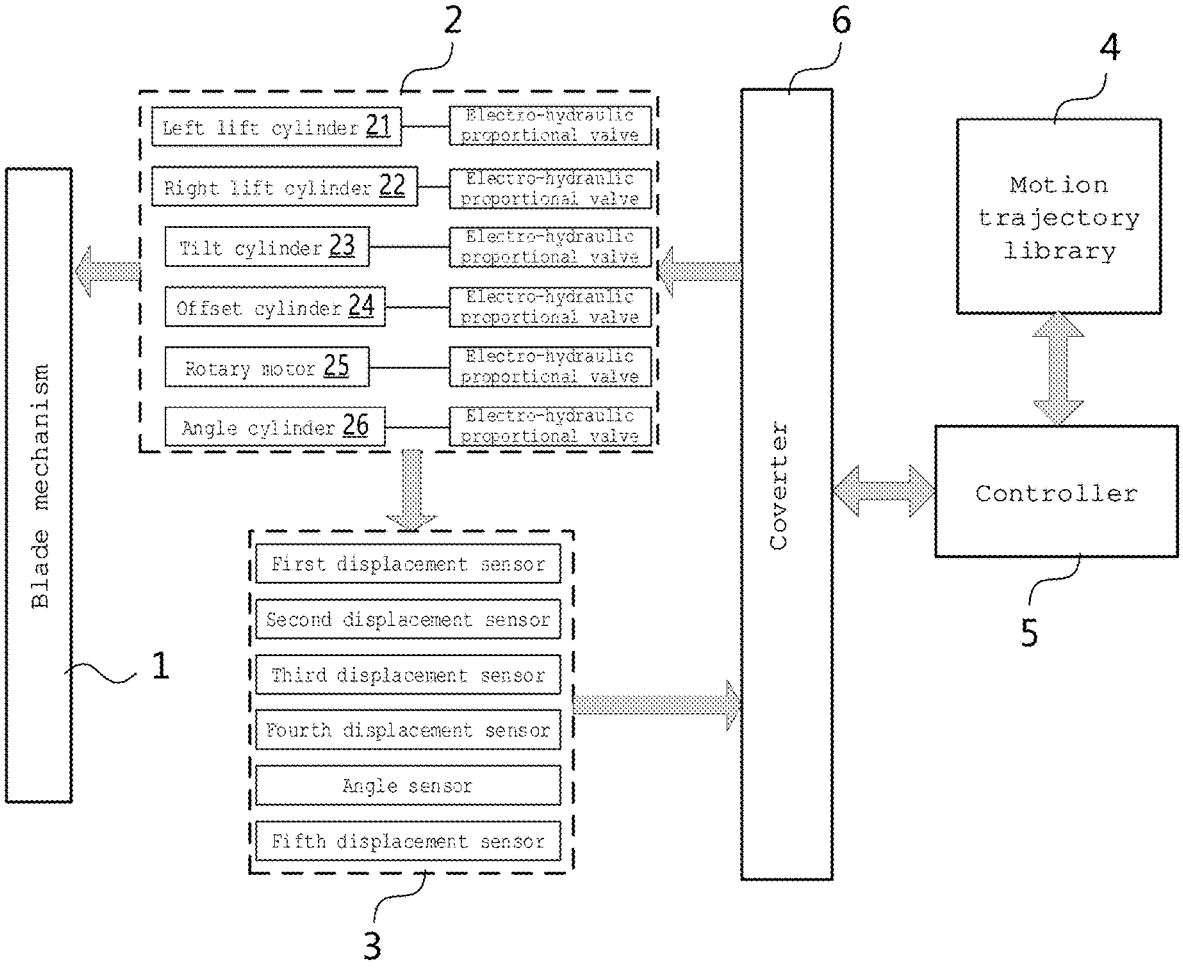
FIG. 1 is a schematic block view of some embodiments of the grader according to the present disclosure.

It should be understood that the dimensions of the various parts shown in the accompanying drawings are not drawn according to the actual scale. In addition, the same or similar reference signs are used to denote the same or similar components.

DETAILED DESCRIPTION

Various exemplary embodiments of the present disclosure will now be described in detail with reference to the accompanying drawings. The description of the exemplary embodiments is merely illustrative and is in no way intended as a limitation to the present disclosure, its application or use. The present disclosure may be implemented in many different forms, which are not limited to the embodiments described herein. These embodiments are provided to make the present disclosure thorough and complete, and fully convey the scope of the present disclosure to those skilled in the art. It should be noticed that: relative arrangement of components and steps, material composition, numerical expressions, and numerical values set forth in these embodiments, unless specifically stated otherwise, should be explained as merely illustrative, and not as a limitation.

The words "first", "second", and similar words used in the present disclosure do not denote any order, quantity or importance, but merely serve to distinguish different parts. Such similar words as "including" or "containing" mean that the element preceding the word encompasses the elements enumerated after the word, and does not exclude the possibility of encompassing other elements as well. The terms "up", "down", "left", "right", or the like are used only to represent a relative positional relationship, and the relative positional relationship may be changed correspondingly if the absolute position of the described object changes.

In the present disclosure, when it is described that a particular device is located between the first device and the second device, there may be an intermediate device between the particular device and the first device or the second device, and alternatively, there may be no intermediate device. When it is described that a particular device is connected to other devices, the particular device may be directly connected to said other devices without an intermediate device, and alternatively, may not be directly connected to said other devices but with an intermediate device.

Unless otherwise defined, all terms (including technical and scientific terms) used herein have the same meanings as the meanings commonly understood by one of ordinary skill in the art to which the present disclosure belongs. It should also be understood that terms as defined in general dictionaries, unless explicitly defined herein, should be interpreted as having meanings that are consistent with their meanings in the context of the relevant art, and not be interpreted in an idealized or extremely formalized sense.

Techniques, methods, and apparatus known to those of ordinary skill in the relevant art may not be discussed in detail, but where appropriate, these techniques, methods, and apparatuses should be considered as a part of this specification.

In some related technologies, the operator adjusts a shoveling operation slope of the grader by visual observation. After studies, it has been found that such method is relatively dependent on the operator's experience, and with a long time and a low efficiency in a single slope adjustment as well as a low slope control accuracy, it is impossible to ensure a high-precision slope construction operation, which results in a poor slope formation accuracy, and it is often necessary to adjust a slope multiple times, thereby seriously affecting the engineering progress.

In other related technologies, the shoveling angle of the blade is adjusted by program control of an angle cylinder of the blade. After studies, it has been found that such method can only realize automatic adjustment of a shoveling angle, but it is difficult to adapt to slope adjustment in multiple operation conditions.

In view of this, the embodiments of the present disclosure provide a grader and a blade control method, which can adapt to slope adjustment in multiple operation conditions.

Figure 2:
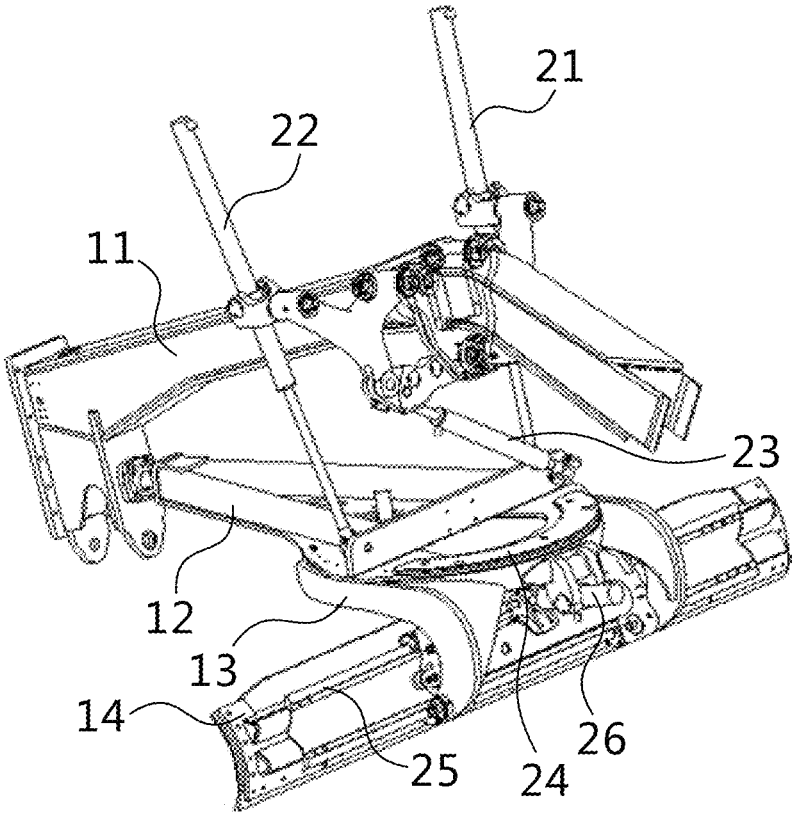
FIG. 2 is a schematic structural view of a blade mechanism and a blade adjusting mechanism in some embodiments of the grader according to the present disclosure.
Figure 3:
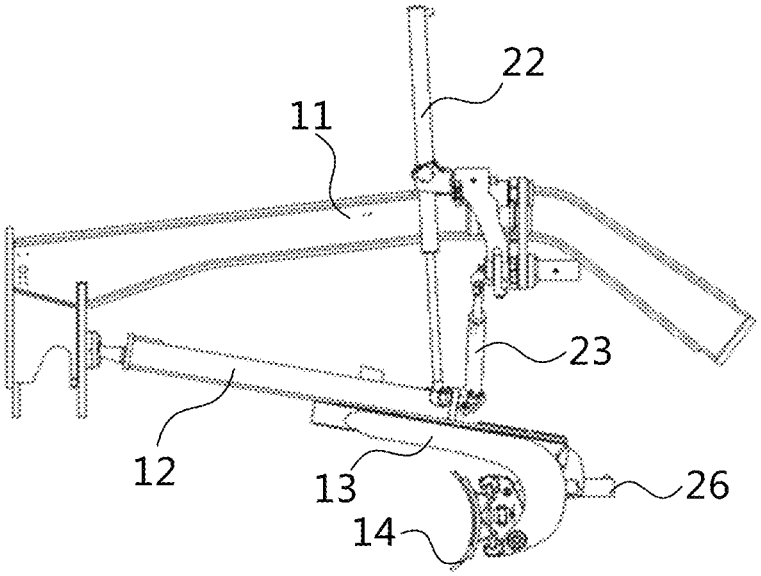
FIG. 3 is a schematic view of the structure of FIG. 2 from another perspective.

FIG. 1 is a schematic block view of some embodiments of the grader according to the present disclosure. FIG. 2 is a schematic structural view of a blade mechanism and a blade adjusting mechanism in some embodiments of the grader according to the present disclosure. FIG. 3 is a schematic view of the structure of FIG. 2 from another perspective.

Referring to FIGS. 1 to 3, in some embodiments, the grader includes: a blade mechanism 1, a blade adjusting mechanism 2, a blade position detecting mechanism 3, a motion trajectory library 4, and a controller 5. The blade mechanism 1 includes a blade 14. The blade adjusting mechanism 2 includes a plurality of adjusting means respectively corresponding to at least two degrees of freedom of the blade 14, and is operably connected with the blade mechanism 1, and configured to adjust a spatial position and/or angle of the blade 14.

The blade position detecting mechanism 3 is configured to detect a slope parameter for characterizing a spatial position of the blade 14. The motion trajectory library 4 is configured to store motion functions of the plurality of adjusting means respectively when different operation conditions and/or different grades are switched. The controller 5 is communicatively connected with the blade adjusting mechanism 2, the blade position detecting mechanism 3, and the motion trajectory library 4, and is configured to call a corresponding motion function in the motion trajectory library 4 according to a set operation condition and a required slope, and control at least one of the plurality of adjusting means according to a position parameter of the blade 14 and the motion function.

In the present embodiment, the controller can call a corresponding motion function in the motion trajectory library according to a set operation condition and a required slope, and control at least one of the plurality of adjusting means according to a position parameter of the blade and the motion function. Based on different operation conditions and required slopes, the blade may be adjusted in a spatial position and/or angle by the blade adjusting mechanism under multiple degrees of freedom. The adjustment process may be implemented in an automatic and orderly adjustment according to the motion function in the motion trajectory library, so that it is possible to not only adapt to slope adjustment under multiple operation conditions, but also improve the slope adjustment efficiency and the grading accuracy.

Figure 6:
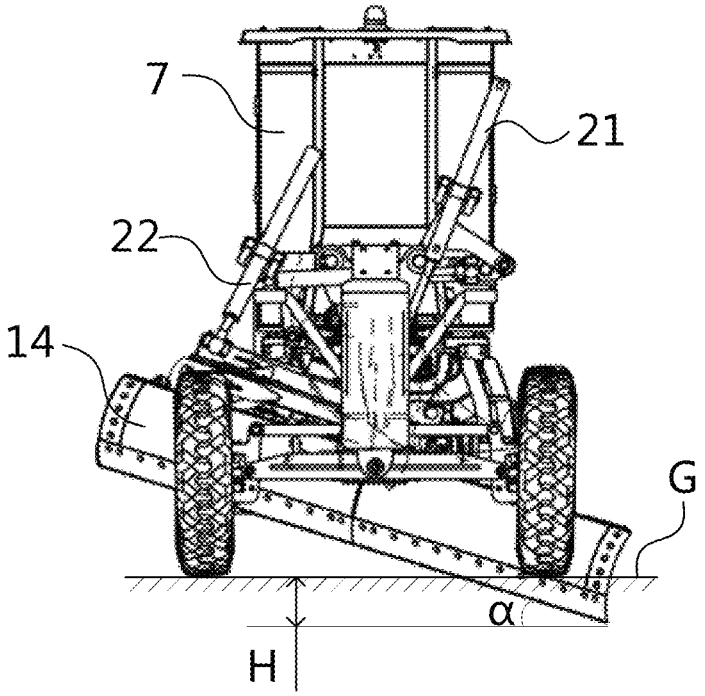

In FIGS. 1 to 3, the blade mechanism 1 further includes: a body frame 11, a swing frame 12, and a rotary support 13. Referring to FIG. 6, the body frame 11 may be disposed on a front side of the cab 7 of the grader, and wheels may be arranged at a front end of the body frame 11 to support the body frame 11. The first end of the swing frame 12 is rotatably connected with the body frame 11, and the first end is an end of the swing frame 12 away from the cab. The rotary support 13 is rotatably connected with the second end of the swing frame 12. The second end of the swing frame 12 is wider than the first end in a latitudinal direction, and the rotation axis of the rotary support 13 may be perpendicular to a plane where the swing frame 12 is located. The blade 14 is rotatably and slidably arranged on the rotary support 13.

Referring to FIGS. 1 to 3, the plurality of adjusting means of the blade adjusting mechanism 2 include: a left lift cylinder 21, a right lift cylinder 22, a tilt cylinder 23, a rotary motor 24, an offset cylinder 25, and an angle cylinder 26. The left lift cylinder 21 and the right lift cylinder 22 are respectively vertically arranged on left and right sides of the body frame 11, and are both connected between the body frame 11 and the second end of the swing frame 12, and configured to drive the swing frame 12 to pitch relative to the body frame 11.

The tilt cylinder 23 is connected between the second end of the swing frame 12 and the body frame 11, and configured to drive the swing frame 12 to side-swing. The rotary motor 24 is connected between the second end of the swing frame 12 and the rotary support 13, and configured to drive the rotary support 13 to rotate relative to the second end of the swing frame 12. The offset cylinder 25 is connected between the blade 14 and the rotary support 13, and configured to drive the blade 14 to slide relative to the rotary support 13. The angle cylinder 26 is connected between the rotary support 13 and the blade 14, and configured to drive the blade 14 to rotate relative to the rotary support 13.

Each adjusting means may perform single-degree-of-freedom adjustment actions separately, or implement multi-degree-of-freedom adjustment by combining with each other. The blade is adjusted by the plurality of adjusting means described above, so that it is possible to implement adjusting a position and angle of the blade on multiple degrees of freedom, and meet the operation requirements of different operation conditions.

Referring to FIG. 1, in some embodiments, the blade adjusting mechanism 2 further includes a plurality of electro-hydraulic proportional valves. The plurality of electro-hydraulic proportional valves may be respectively connected with the left lift cylinder 21, the right lift cylinder 22, the tilt cylinder 23, the rotary motor 24, the offset cylinder 25 and the angle cylinder 26, and be all communicatively connected with the controller 5. Regarding a driving method of the adjusting means with hydraulic oil, the controller 5 outputs different electro-hydraulic proportional signals to each electro-hydraulic proportional valve to realize turning on/off and the hydraulic flow control of the electro-hydraulic proportional valve.

In order to enable the controller 5 to smoothly communicate with the blade position detecting mechanism 3 and the electro-hydraulic proportional valve or the like, referring to FIG. 1, in some embodiments, the grader further includes a converter 6, which is configured to convert a slope parameter detected by the blade position detecting mechanism 3 into a recognizable signal for the controller 5, and convert a control instruction outputted by the controller 5 into electro-hydraulic proportion signals of the plurality of electro-hydraulic proportional valves.

In some embodiments, the converter 6 may be provided separately from the controller 5 and connected to the controller 5 through wired or wireless communication. In other embodiments, the converter 6 may be integrated in the controller 5.

Referring to FIG. 1, the motion trajectory library may be provided separately from the controller 5, or may be provided in a memory built into the controller 5. The motion trajectory library can store motion functions of the plurality of adjusting means respectively when different operation conditions and/or different grades are switched.

When a current operation condition is different from a set operation condition, the current operation condition includes an initial operation condition in which each adjusting means is in an initial position, so that it is possible to firstly allow each adjusting means to adjust the blade to an initial position, which is also an initial position of each adjusting means.

For example, if the current operation condition is a scraping groove operation condition and the set operation condition is a blade flat shoveling operation condition, then each adjusting means is firstly adjusted to an initial position. The blade flat shoveling operation condition involves a cross slope angle and a grading angle of the blade, and corresponds to adjustment actions of the left lift cylinder, the right lift cylinder and the angle cylinder. The required slope includes (a cross slope angle $\alpha$, a grading angle $\beta$), and $(\alpha, \beta)=(\alpha_1, \beta_1)$, then the controller respectively calculates adjustment amounts of the left lift cylinder, the right lift cylinder and the angle cylinder respectively corresponding to $\alpha_1$ and $\beta_1$ according to the motion function.

When the current operation condition is the same as the set operation condition, there is no need to firstly adjust each adjusting means to its initial position, but to make incremental adjustments based on the current slope. That is, the controller controls at least one of the plurality of adjusting means corresponding to a required slope according to the motion function, and maintains the current states of other adjusting means among the plurality of adjusting means, so as to directly adjust the blade to a spatial position that meets the set operation condition and the required slope.

For example, if the current operation condition and the set operation condition are both a blade flat shoveling operation condition, the blade position detecting mechanism may detect the cross slope angle $\alpha$ and the grading angle $\beta$ of the blade related to the required slope, and respectively calculate a difference with the cross slope angle $\alpha$ and the grading angle $\beta$ in the required slope, so as to obtain an increment of each slope parameter. Then, the controller may calculate an adjustment amount of at least one of the left lift cylinder, the right lift cylinder, and the angle cylinder according to the increment of each slope parameter and the motion function.

In order to calculate a slope parameters of the blade under each degree of freedom, referring to FIG. 1, in some embodiments, the blade position detecting mechanism 3 includes: a first displacement sensor, a second displacement sensor, a third displacement sensor, and a fourth displacement sensor, a fifth displacement sensor and an angle sensor. The first displacement sensor and the second displacement sensor are respectively connected with the left lift cylinder 21 and the right lift cylinder 22, and configured to detect displacements of the left lift cylinder 21 and the right lift cylinder 22 respectively. The third displacement sensor is connected to the tilt cylinder 23, and configured to detect a displacement of the tilt cylinder 23. The fourth displacement sensor is connected to the offset cylinder 25, and configured to detect a displacement of the offset cylinder 25. The fifth displacement sensor is connected to the angle cylinder 26, and configured to detect the displacement of the angle cylinder 26. The angle sensor is connected to the rotary motor 24, and configured to detect a rotation angle of the rotary motor 24.

In other embodiments, the blade position detecting mechanism 3 may also include other types of sensors that detect a position or angle of the blade, such as a gyroscope, an angle sensor, and the like.

Figure 9:
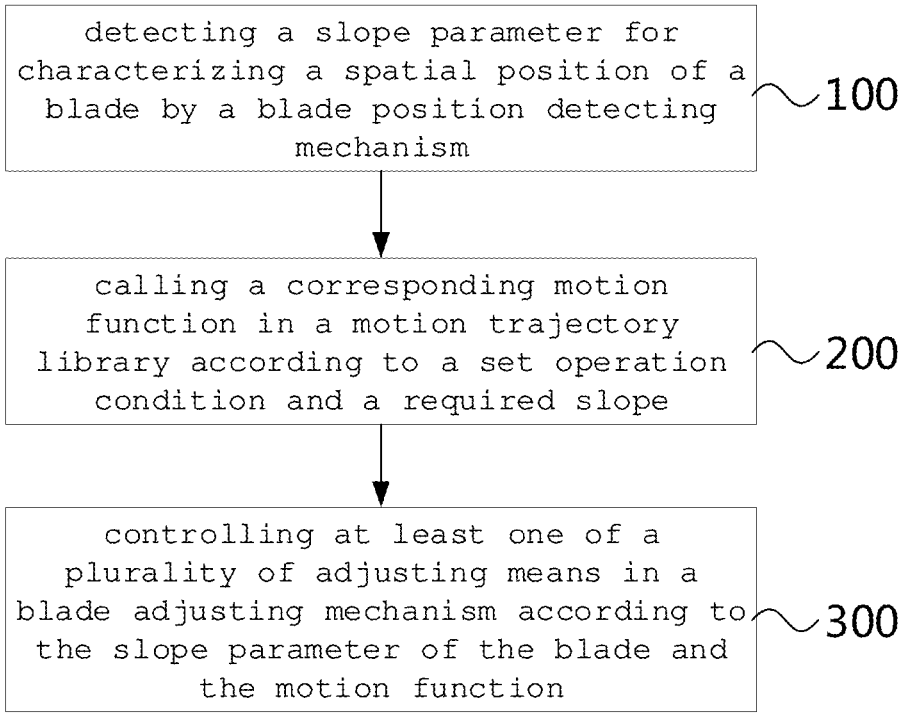
FIG. 9 is a schematic flowchart of some embodiments of the blade control method according to the present disclosure.

With reference to the foregoing various embodiments of the grader, the present disclosure also provides a plurality of embodiments of the blade control method. As shown in FIG. 9, it is a schematic flowchart of some embodiments of the blade control method according to the present disclosure. Referring to FIG. 9, the blade control method based on the foregoing embodiments of the grader includes step 100 to step 300. In step 100, a slope parameter for characterizing a spatial position of the blade 14 is detected by the blade position detecting mechanism 3. In step 200, a corresponding motion function is called in the motion trajectory library 4 according to a set operation condition and a required slope. In step 300, at least one of the plurality of adjusting means in the blade adjusting mechanism 2 is controlled according to the slope parameter of the blade 14 and the motion function. In the present embodiment, step 100 to step 300 may be executed by the controller 5 or according to an instruction issued by the controller 5.

In some embodiments, the blade control method further includes: if a current operation condition of the grader is different from a set operation condition, adjusting the blade 14 to an initial position by the blade adjusting mechanism 2, and then controlling at least one of the plurality of adjusting means according to the motion function, so as to adjust the blade 14 to a spatial position that meets the set operation condition and the required slope. If a current operation condition of the grader is the same as a set operation condition, one of the plurality of adjusting means is controlled according to the motion function, and current states of the other adjusting means among the plurality of adjusting means are maintained so that the blade 14 is directly adjusted to a spatial position that meets a set operation condition and a required slope. These steps may also be executed by the controller 5 or according to an instruction issued by the controller 5.

In order to achieve different operation effects, the operation condition of the grader may include at least one of the following: a flat shoveling operation condition, a scraping groove operation condition or a scraping slope operation condition. When the blade position detecting mechanism 3 includes a plurality of sensors respectively corresponding to the plurality of adjusting means, step 100 may specifically include: detecting motion adjustment amounts of the plurality of adjusting means relative to an initial position of the blade 14 by the plurality of sensors respectively; calculating slope parameters of the blade under different operation conditions respectively according to the motion adjustment amounts of the plurality of adjusting means relative to an initial position of the blade 14.

Figure 4:
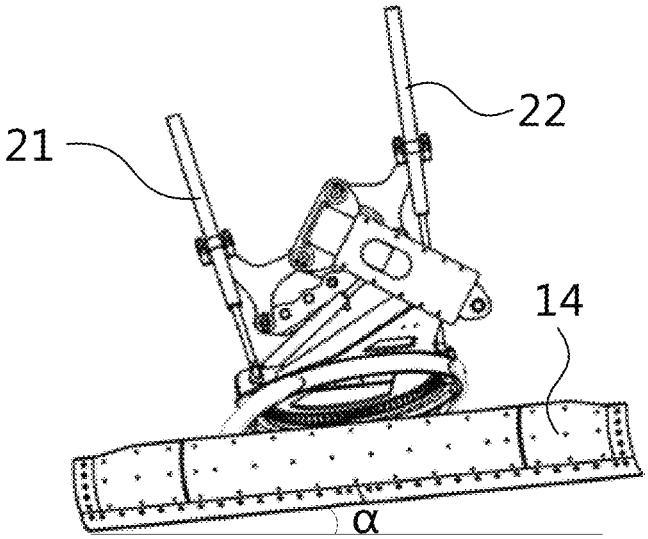
FIGS. 4 to 7 are respectively schematic views of slope parameters of a blade in some embodiments of the grader of the present disclosure.
Figure 5:
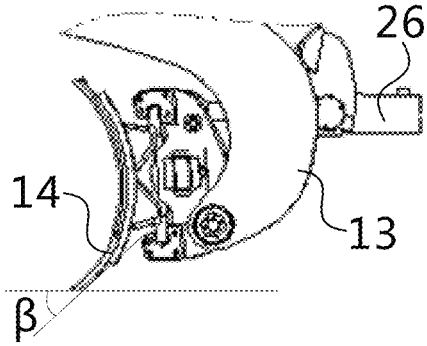

Referring to FIGS. 4 and 5, the blade is in a flat shoveling operation condition. Under such operation condition, a length direction of the blade is perpendicular to a forward direction of the grader, so that it is possible to achieve a horizontal or sloped grading effect on the operation surface. The first angle $\alpha$ and the second angle $\beta$ of the blade 14 may be calculated when the blade 14 is in the flat shoveling operation condition. The first angle $\alpha$ is an included angle between a lower edge of the blade 14 and an operation surface of the grader, and the second angle $\beta$ is an included angle between a scraping surface of the blade 14 adjacent to the lower edge and the operation surface.

The calculation of the first angle $\alpha$ may be realized by respectively detecting a displacement X1 of the left lift cylinder 21 and a displacement X2 of the right lift cylinder 22 by the first displacement sensor and the second displacement sensor. For example, it may be calculated by a preset first motion function: $\alpha=K1*X1+K2*X2$. The displacement X1 here may be a difference between an extension amount of the piston rod of the left lift cylinder and an extension amount of the piston rod at an initial position, and the displacement X2 may be a difference between an extension amount of the piston rod of the right lift cylinder and an extension amount of the piston rod at an initial position. The first motion function may be obtained by calibrating the left lift cylinder 21 and the right lift cylinder 22, for example, by fitting the motion coefficients K1 and K2 through a plurality of first angles $\alpha$ corresponding to multiple groups (X1, X2).

The calculation of the second angle $\beta$ may be realized by detecting a displacement X6 of the angle cylinder 26 by the fifth displacement sensor. For example, it is calculated by the preset second motion function: $\beta=K6*X6$. The displacement X6 here may be a difference between an extension amount of the piston rod of the angle cylinder 26 and an extension amount of the piston rod at an initial position. The second motion function may be obtained by calibrating the angle cylinder 26, for example, by fitting the motion coefficient K6 through a plurality of second angles $\beta$ corresponding to multiple groups X6.

Referring to FIG. 6, the blade is in a scraping groove operation condition. Under such operation condition, a length direction of the blade is perpendicular to a forward direction of the grader, and the blade extends a certain length downwards along a length direction to form a certain depth of scraping effect on the operation surface. When the blade 14 is in the scraping groove operation condition, the first angle $\alpha$ and the penetration depth H of the blade 14 may be calculated. Here, the first angle $\alpha$ is an included angle between a lower edge of the blade 14 and the operation surface G of the grader, and the first motion function used in its calculation can refer to the description of the flat shoveling operation condition above, which will not be described in detail here.

The penetration depth H is a distance between the lowest position of the blade 14 and the operation surface G. The calculation of the penetration depth H may be implemented by detecting the displacement X1 of the left lift cylinder 21, the displacement X2 of the right lift cylinder 22, and the displacement X4 of the offset cylinder 25 by the first displacement sensor, the second displacement sensor, and the fourth displacement sensor respectively. For example, it may be calculated by the preset third motion function: $H=K1*X1+K2*X2+K4*X4$. The displacement X4 here may be a difference between an extension amount of the piston rod of the offset cylinder 25 and an extension amount of the piston rod at an initial position. The third motion function may be obtained by calibrating the left lift cylinder 21, the right lift cylinder 22 and the offset cylinder 25, for example, by fitting the motion coefficients K1, K2 and K4 through a plurality of penetration depths H K1, K2 and K4 corresponding to multiple groups (X1, X2, X4).

Figure 7:
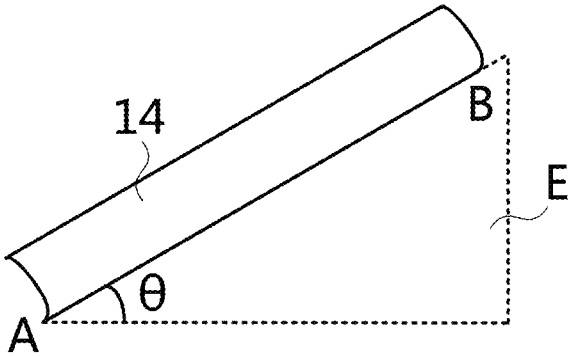
Figure 8:
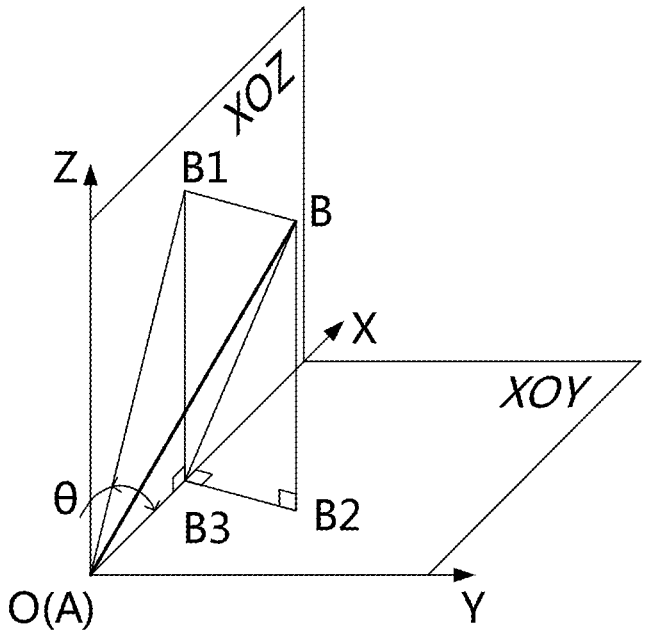
FIG. 8 is a schematic view of a scraping slope angle $\theta$ of the blade in FIG. 7 under a Cartesian coordinate axis.

With reference to FIGS. 7 and 8, the blade 14 is in a scraping slope operation condition. Under such operation condition, the blade swings to the left or right side of the body frame by a certain angle, and after scraping slope operation, it may form an included angle with the horizontal plane. In FIG. 7, the included angle between the side slope E and the horizontal plane is calculated as a third angle $\theta$ of the blade when the blade is in the scraping slope operation condition. In the Cartesian coordinate system shown in FIG. 8, the X axis represents a forward direction of the grader, the Z axis represents a vertical direction, and the Y axis is perpendicular to an XOZ plane formed by the X axis and the Z axis.

Assuming that the two end points of the lower edge of the blade 14 are A and B respectively, the line segment formed by A and B is translated along with the point A to the point O, and the point B is projected to the XOY plane and the XOZ plane respectively to obtain the projection points $B_2$ and $B_1$ which are both projected to the X axis to obtain the projection point $B_3$. Here, $\angle B_1AB_3$ is the third angle $\theta$.

The calculation of the third angle $\theta$ may be implemented by detecting the displacement X1 of the left lift cylinder 21, the displacement X2 of the right lift cylinder 22, the displacement X3 of the tilt cylinder 23, the displacement X4 of the offset cylinder 25, the displacement X5 of the rotary motor 24 and the displacement X6 of the angle cylinder 26 by the first displacement sensor, the second displacement sensor, the third displacement sensor, the fourth displacement sensor, the angle sensor and the fifth displacement sensor. For example, it may be calculated by the preset fourth motion function: $\theta=K1*X1+K2*X2+K3*X3+K4*X4+K5*X5+K6*X6$.

The displacement X3 here may be a difference between an extension amount of the piston rod of the tilt cylinder 24 and an extension amount of the piston rod at an initial position, and the rotation angle X5 may be a difference between the rotation angle of the rotary motor 24 and the rotation angle at an initial position. The fourth motion function may be obtained by calibrating the left lift cylinder 21, the right lift cylinder 22, the tilt cylinder 23, the rotary motor 24, the offset cylinder 25 and the angle cylinder 26, for example, by fitting the motion coefficients K1, K2, K3, K4, K5, and K6 through a plurality of third angles e corresponding to multiple groups (X1, X2, X3, X4, X5, X6).

Referring to FIG. 9, in step 200, the operator of the grader may select an operation condition and a required slope by means of an operation panel or a remote controller. The operation condition may be at least one of the following: a flat shoveling operation condition, a scraping groove operation condition and a scraping slope operation condition. The required slope may include at least one of the following: a first angle and a second angle of the blade under the flat shoveling operation condition, a first angle and a penetration depth under the scraping groove operation condition, or a third angle under the scraping slope operation condition.

By way of the above-described description of the grader and the blade control method, it may be understood that the embodiments of the present disclosure may achieve at least one of the following technical effects: adapting to more operation conditions; improving the operating efficiency of the blade, reducing the slope adjustment time; improving the slope formation precision; and reducing manual intervention and operation. In addition, the grader of the present disclosure may be either a construction grader or an agricultural grader.

The controller mentioned above may be a general-purpose processor, a special-purpose processor, a microprocessor or a state machine, or may be a combination of computing devices, such as a combination of a DSP and a microprocessor, a combination of multiple microprocessors, or one or more microprocessors collaborating with DSP core. The steps of the blade control method in the present disclosure may be directly embodied in hardware, in a software module executed by a processor, or in a combination thereof. The software module may reside in a RAM memory, a flash memory, a ROM memory, an EPROM memory, an EEPROM memory, a register, a hard disk, a removable disk, a CD-ROM, or any other form of storage medium known in the art.

Hereto, various embodiments of the present disclosure have been described in detail. Some details well known in the art are not described to avoid obscuring the concept of the present disclosure. According to the above description, those skilled in the art would fully know how to implement the technical solutions disclosed herein.

Although some specific embodiments of the present disclosure have been described in detail by way of examples, those skilled in the art should understand that the above examples are only for the purpose of illustration and are not intended to limit the scope of the present disclosure. It should be understood by those skilled in the art that modifications to the above embodiments and equivalently substitution of part of the technical features may be made without departing from the scope and spirit of the present disclosure. The scope of the present disclosure is defined by the appended claims.

What is claimed is:

1. A blade control method of a grader wherein the grade comprises a blade mechanism comprising a blade, a blade adjusting mechanism comprising a plurality of adjusting means respectively corresponding to at least two degrees of freedom of the blade, a blade position detecting mechanism, and a motion trajectory library, and the blade control method comprises:

detecting a slope parameter for characterizing a spatial position of a blade by a blade position detecting mechanism;

calling a corresponding motion function in a motion trajectory library according to a set operation condition and a required slope; and controlling at least one of the plurality of adjusting means in the blade adjusting mechanism according to the slope parameter of the blade and the motion function;

wherein the operation condition comprises at least one of the following: a flat shoveling operation condition, a scraping groove operation condition, or a scraping slope operation condition, the blade position detecting mechanism comprises a plurality of sensors respectively corresponding to the plurality of adjusting means, and the step of detecting a slope parameter for characterizing a spatial position of a blade by a blade position detecting mechanism comprises:

detecting motion adjustment amounts of the plurality of adjusting means relative to an initial position of the blade by the plurality of sensors respectively;

calculating a first angle and a second angle of the blade when the blade is in the flat shoveling operation condition, calculating the first angle and a penetration depth of the blade when the blade is in the scraping groove operation condition, and calculating a third angle of the blade when the blade is in the scraping slope operation condition, according to the motion adjustment amounts of the plurality of adjusting means relative to the initial position of the blade, wherein the first angle is an included angle between a lower edge of the blade and an operation surface of the grader, and the second angle is an included angle between a scraping surface of the blade adjacent to the lower edge and the operation surface, the penetration depth is a distance between the lowest position of the blade and the operation surface, and the third angle is an included angle between a side slope formed after scraping slope by the blade and a horizontal plane.

2. The blade control method according to claim 1, further comprising:

if a current operation condition of the grader is different from the set operation condition, adjusting the blade to an initial position by the blade adjusting mechanism, and then controlling at least one of the plurality of adjusting means according to the motion function, so as to adjust the blade to a spatial position that meets the set operation condition and the required slope; and if a current operation condition of the grader is the same as the set operation condition, controlling at least one of the plurality of adjusting means corresponding to the required slope according to the motion function, and maintaining current states of the other adjusting means among the plurality of adjusting means, so as to directly adjust the blade to a spatial position that meets the set operation condition and the required slope.

3. The blade adjusting method according to claim 1, wherein the required slope comprises at least one of the following:

the first angle and the second angle of the blade under the flat shoveling operation condition;

the first angle and the penetration depth under the scraping groove operation condition; or the third angle under the scraping slope operation condition.

4. A blade control method of a grader, wherein the grade comprises a blade mechanism, a blade adjusting mechanism, a blade position detecting mechanism, and a motion trajectory library, the blade mechanism comprises a blade, a body frame comprising a plurality of adjusting means respectively corresponding to at least two degrees of freedom of the blade, a swing frame having a first end rotatably connected with the body frame, and a rotary support rotatably connected with a second end of the swing frame, the plurality of adjusting means comprise:

a left lift cylinder and a right lift cylinder vertically arranged on left and right sides of the body frame respectively, the left lift cylinder and the right lift cylinder being connected between the body frame and the second end of the swing frame and configured to drive the swing frame to pitch relative to the body frame;

a tilt cylinder, connected between the second end of the swing frame and the body frame and configured to drive the swing frame to side-swing;

a rotary motor, connected between the second end of the swing frame and the rotary support and configured to drive the rotary support to rotate relative to the second end of the swing frame;

an offset cylinder, connected between the blade and the rotary support and configured to drive the blade to slide relative to the rotary support; and an angle cylinder connected between the rotary support and the blade to drive the blade to rotate relative to the rotary support;

and wherein the blade control method comprises:

detecting a slope parameter for characterizing a spatial position of a blade by a blade position detecting mechanism;

calling a corresponding motion function in a motion trajectory library according to a set operation condition and a required slope; and controlling at least one of a plurality of adjusting means in a blade adjusting mechanism according to the slope parameter of the blade and the motion function;

wherein the step of calculating a slope parameter of the blade according to the rotation angle and each displacement by referring to a current operation condition of the grader comprises:

if the current operation condition of the blade is a flat shoveling operation condition, calculating a first angle $\alpha$ of the blade by a preset first motion function, and calculating a second angle $\beta$ of the blade by a preset second motion function, wherein the preset first motion function is: $\alpha=K1*X1+K2*X2$, the preset second motion function is: $\beta=K6*X6$;

if the current operation condition of the blade is a scraping groove operation condition, calculating a first angle $\alpha$ of the blade by the preset first motion function, and calculating a penetration depth H of the blade by a preset third motion function, wherein the preset third motion function is: $H=K1*X1+K2*X2+K4*X4$; and if the current operation condition of the blade is a scraping slope operation condition, calculating a third angle $\theta$ of the blade by a preset fourth motion function, wherein the preset fourth motion function is: $\theta=K1*X1+K2*X2+K3*X3+K4*X4+K5*X5+K6*X6$, wherein K1, K2, K3, K4, K5, and K6 are all motion coefficients after calibrating a plurality of adjusting means, the first angle $\alpha$ is an included angle between a lower edge of the blade and an operation surface of the grader, the second angle $\beta$ is an included angle between the scraping surface of the blade adjacent to the lower edge and the operation surface, the penetration depth H is a distance between the lowest position of the blade and the operation surface, the third angle $\theta$ is an included angle between a side slope formed after scraping slope by the blade and a horizontal plane, X1 is a displacement of the left lift cylinder, X2 is a displacement of the right lift cylinder, X3 is a displacement of the tilt cylinder, X4 a displacement of the offset cylinder, X5 is a rotation angle of the rotary motor, and X6 is a displacement of the angle cylinder.

5. The blade control method of the grader according to claim 4, wherein the blade position detecting mechanism comprises: a first displacement sensor and a second displacement sensor which are connected with the left lift cylinder and the right lift cylinder respectively, a third displacement sensor connected to the tilt cylinder, a fourth displacement sensor connected to the offset cylinder; a fifth displacement sensor connected to the angle cylinder; and an angle sensor connected to the rotary motor; and the step of detecting a slope parameter for characterizing a spatial position of the blade by the blade position detecting mechanism comprises:

detecting the displacement X1 of the left lift cylinder and the displacement X2 of the right lift cylinder by the first displacement sensor and the second displacement sensor respectively;

detecting the displacement X3 of the tilt cylinder by the third displacement sensor;

detecting the displacement X4 of the offset cylinder by the fourth displacement sensor;

detecting the rotation angle X5 of the rotary motor by the angle sensor;

detecting the displacement X6 of the angle cylinder by the fifth displacement sensor; and calculating the slope parameter of the blade according to the rotation angle and each displacement by referring to the current operation condition of the grader.

* * * * *